US008113881B2

(12) United States Patent
Sakamoto

(10) Patent No.: US 8,113,881 B2
(45) Date of Patent: Feb. 14, 2012

(54) CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/468,924

(22) Filed: May 20, 2009

(65) Prior Publication Data

US 2009/0291590 A1 Nov. 26, 2009

(30) Foreign Application Priority Data

May 20, 2008 (JP) ..... 2008-132522

(51) Int. Cl.
*H01R 13/40* (2006.01)

(52) U.S. Cl. ..... 439/595

(58) Field of Classification Search ..... 439/595, 439/752, 744, 746, 748
See application file for complete search history.

(56) References Cited

U.S. PATENT DOCUMENTS

| | | | | |
|---|---|---|---|---|
| 6,623,313 | B1 | 9/2003 | Ichida et al. | |
| 6,790,085 | B2 * | 9/2004 | Nankou et al. | 439/595 |
| 6,796,836 | B2 | 9/2004 | Ichida et al. | |
| 6,953,358 | B2 | 10/2005 | Ichida et al. | |
| 2003/0027455 | A1 * | 2/2003 | Yamawaki et al. | 439/595 |
| 2003/0190841 | A1 * | 10/2003 | Nakamura et al. | 439/595 |
| 2005/0227548 | A1 * | 10/2005 | Sian | 439/752 |

FOREIGN PATENT DOCUMENTS

JP 2004-014305 A 1/2004

* cited by examiner

*Primary Examiner* — Alexander Gilman
(74) *Attorney, Agent, or Firm* — Sughrue Mion, PLLC

(57) ABSTRACT

A connector includes a connector housing forming a cavity extending from a rectangular opening and including a top wall and a bottom wall which face each other, a first engagement portion provided on the bottom wall, a second engagement portion which is elastically deformable provided on the top wall; and a terminal including a frame having a box shape which includes an upper outer surface and a lower outer surface which face each other, a first engaged portion provided on the lower outer surface, a second engaged portion provided on the upper outer surface, and a conductive contact provided in the frame. The first engagement portion and the second engagement portion are engaged with the first engaged portion and the second engaged portion respectively when the terminal is inserted into the connector housing.

12 Claims, 2 Drawing Sheets

11
11a
11b
11c
11d
11e
11f
11g
11h
11i
11j
11k
10
20
21
21a
21b
21c
21d
21e
22
23

CONNECTOR

CROSS-REFERENCE TO RELATED APPLICATIONS

This application claims priority from Japanese Patent Application No. 2008-132522 filed on May 20, 2008, the entire subject matter of which is incorporated herein by reference.

BACKGROUND

The invention is related to a connector in which a female type terminal (F-terminal), into which a male type terminal (M-terminal) is inserted and detached, is surely engaged to a resin connector housing with a simple structure and high engagement force.

The F-terminal is engaged with the resin connector housing as a base for the connector when the female type connector is used. An engagement structure of the F-terminal with the connector housing is important to improve reliability of the connector.

There are two types of such engagement structures. The first type is a terminal lance structure in which a detent so called lance is provided on the F-terminal itself. The second type is a case lance structure in which a detent is provided in the connector housing. In view of reliability, the case lance structure is dominant.

Above mentioned "lance" is a terminology in the field of the invention. "lance" means a member for engagement with elasticity.

As an example of a connector adopting the case lance structure, a terminal clasp and a connector preferable for miniaturization are described in JP-2004-14305A.

The connector shown in JP-2004-14305A includes a connector housing having terminal accommodating spaces (cavities) provided on upper and lower stages and arranged in a width direction, and a plurality of F-terminal each of which is engaged with a drop prevention part (lance) when the F-terminal is inserted into the space from back side of the space. A cut out portion is provided on an outside wall of the F-terminal so as to allow the drop prevention portion in the connector housing to advance, and an engagement protrusion engaging with the drop prevention portion is formed by outwardly protruding a part of a cutting front edge of the cut out portion.

The drop prevention portion in the connector housing is a lance which protrudes from a bottom inner wall of the cavity and is elastically deformable.

According to the connector described in JP-2004-14305A, when the F-terminal for inserting the M-terminal is mounted in the resin connector housing, the F-terminal is engaged within the connector housing by advancing the lance that is elastically deformable in the connector housing into the cut out portion provided on the outside wall of the F-terminal by using elastic force of the resin.

However, the more the miniaturization of the connector housing develops, the more the pitch of adjacent cavities becomes narrow. As a result, a width of the lance provided in the connector housing becomes narrow. Therefore, the engagement force of the lance to engage the F-terminal within the connector housing is lowered due to lack of strength of the lance.

Accordingly, a connector in which a F-terminal into which a M-terminal is inserted and detached is surely engaged to a resin connector housing with a simple structure and high engagement force is required.

SUMMARY

The present invention is devised in view of the above mentioned problem. The first aspect of the invention is a connector including a connector housing forming a cavity extending from a rectangular opening and including a top wall and a bottom wall which face each other, a first engagement portion provided on the bottom wall, a second engagement portion which is elastically deformable provided on the top wall; and a terminal including a frame having a box shape which includes an upper outer surface and a lower outer surface which face each other, a first engaged portion provided on the lower outer surface, a second engaged portion provided on the upper outer surface, and a conductive contact provided therein for contacting with a mating connector. The first engagement portion and the second engagement portion are engaged with the first engaged portion and the second engaged portion respectively when the terminal is inserted into the connector housing.

The second aspect of the invention is a connector according to the first aspect of the invention such that the one of the first engagement portion and the first engaged portion is a recess portion and the other of the first engagement portion and the first engaged portion is a protrusion.

The third aspect of the invention is a connector according to the first and the second aspect of the invention such that the connector housing includes an arm supported by the top inner wall so as to elastically deform. The second engagement portion is a protrusion protruding from a tip of the arm and the second engaged portion is a protrusion protruding from the upper outer surface.

According to the invention, when the connector is miniaturized, even the pitch of the adjacent cavities in the connector housing becomes narrow in width so that the first engagement portion formed on the inner wall and the second engagement portion formed on another inner wall opposing to the one inner wall so as to be elastically deformable become narrow, the first and the second engagement portion which are integrally formed with the connector housing in a simple structure enhance the engagement to the first and the second engaged portions. Also, the engagement between the first engagement portion and the first engaged portion, the engagement between the second engagement portion and the second engaged portion are both work equally when the F-terminal is engaged within the connector housing because only the second engagement portion is elastically deformable.

DETAILED DESCRIPTION OF EXEMPLARY EMBODIMENTS OF THE PRESENT INVENTION

Hereinafter, an embodiment of the invention is described with reference to FIGS. 1A-1D to FIG. 3.

Figures 1A, 1B, 1C, 1D:
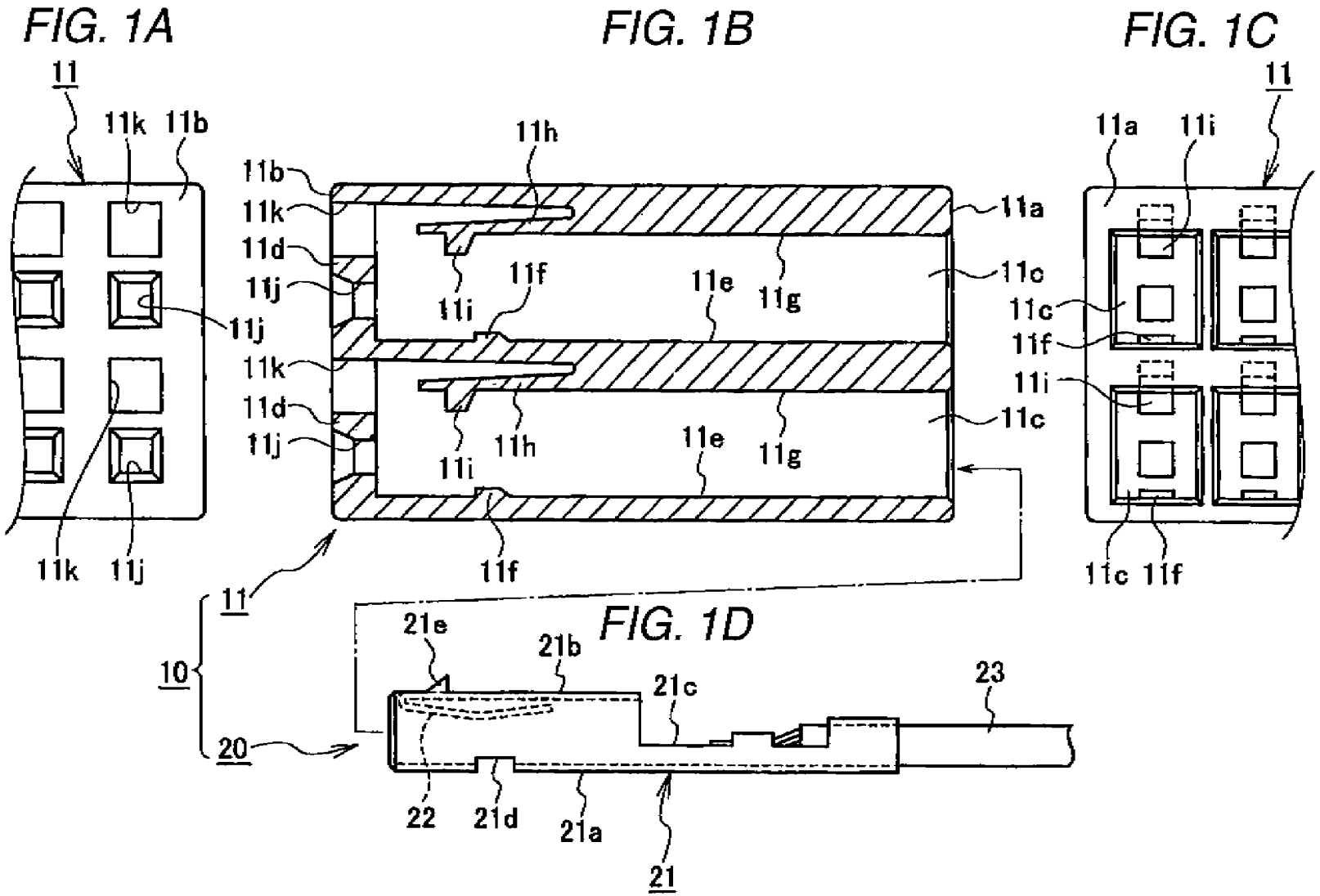
FIG. 1A is a left side view of a connector housing in order to explain a connector of an embodiment.
FIG. 1B is a vertical cross sectional view of the connector housing in order to explain a connector of an embodiment.
FIG. 1C is a right side view of a connector housing in order to explain a connector of an embodiment.
FIG. 1D shows a female type terminal (F-terminal).

FIG. 1A is a left side view of a connector housing. FIG. 1B is a vertical cross sectional view of the connector housing. FIG. 1C is a right side view of the connector housing. FIG. 1D shows a female type terminal (F-terminal).

As shown in FIGS. 1A to 1D, a connector 10 of the embodiment includes a resin connector housing 11, a female type terminal (F-terminal) 20 of an elongate shape into which a mating male type terminal (M-terminal) is inserted and detached. The plurality of F-terminals 20 are accommodated in the connector housing 11 so as to be engaged with the connector housing 11.

The connector housing 11 is integrally molded by injection molding in a rectangular parallel piped shape. The connector housing 11 is made of a non-conductive synthetic resin, for example a white resin.

The connector housing 11 has a plurality of cavities 11*c* (terminal accommodating spaces). Each of the cavities 11*c* extends from rectangular openings on a rear side 11*a* to a front side 11*b* of the connector housing 11. For example, the cavities are provided on upper and lower stages and arranged in plural in a width direction. A front wall 11*d* is vertically provided between the front side 11*b* and the cavities 11*c*.

The cavity 11*c* is formed in a long rectangular parallel piped shape corresponding to the long shape of the F-terminal 20. A vertical size of the cavity 11*c* is set larger than a vertical size of the F-terminal 20 so that the F-terminal is smoothly inserted. On the other hand, a width of the cavity 11*c* that is perpendicular to the sheet (see FIG. 1B) is substantially same as a width of the F-terminal 20. Thus, the F-terminal 20 is able to be inserted into and accommodated within the cavity 11*c* from the rear side 11*a*.

In each of the cavities 11*c*, a first trapezoidal protrusion 11*f* which works as a first engagement portion is integrally formed so as to be protruded from a bottom inner wall 11*e* of the cavity. A second trapezoidal protrusion 11*i* which works as a second engagement portion is protruded from a tip of an arm 11*h*. The arm is supported by a top inner wall 11*g* which is opposite to the bottom wall 11*e* so as to elastically deformable (able to swing). The first engagement portion 11*f* and the second engagement portion 11*i* are engaged with a first engaged portion 21*d* and a second engaged portion 21*e* respectively. The first engaged portion 21*d* and the second engaged portion 21*e* are provided on a lower outer surface 21*a* and an upper outer surface 21*b* of a frame 21 (described later) of the F-terminal respectively.

In the cavity 11*c* of the connector housing 11, the first trapezoidal protrusion 11*f* protrudes with a low height from the bottom inner wall 11*e* to the inside of the cavity 11*c*. The first trapezoidal protrusion 11*f* has an inclined surface which is inclined to the rear side 11*a*. The F-terminal 20 is smoothly inserted into the cavity 11*c* because of the inclined surface In the cavity 11*c* of the connector housing 11, the arm 11*h* extends along the top inner wall 11*g* toward the front side 11*b*. The arm 11*h* is supported so as to be elastically deformable (able to swing) by elasticity of the resin and be substantially parallel to the top inner wall 11*g*. A rear side of the arm 11*h* works as a fulcrum point for swing. The second trapezoidal protrusion 11*i* protrudes with a low height from the tip of the arm 11*h* to the inside of the cavity 11*c*. The second trapezoidal protrusion 11*i* works as an elastically deformable lance.

The second trapezoidal protrusion 11*i* has an inclined surface which is inclined in a direction in which the F-terminal is inserted. The F-terminal 20 is smoothly inserted into the cavity 11*c* because of the inclined surface.

A first hole 11*j* through which a male type terminal (M-terminal) (not shown) is inserted and detached is provided on the front side 11*b* of the connector housing 11. A second hole 11*k* through which a terminal pull out jig (not shown) is inserted and detached is provided on the front side 11*b* of the connector housing 11. The first and the second holes 11*j* 11*k* penetrate the front side 11*b* into the inside of the cavity.

In the F-terminal 20, the frame 21 formed be bending is made from a metal plate into a elongated box shape.

In the frame 21, a cut out portion 21*c* is provided on a rear side of the upper outer surface 21*a* which is opposite to the lower outer surface 21*a* of the elongated shape so as to form a step shape from the top outer surface 21*b*. The frame 21 has a conductive contact 22 to which the M-terminal contacts. The conductive contact 22 is provided at the front side of the frame 21 from which the F-terminal 20 is inserted in the connector housing 11. The cut out portion 21*c* press-holds a wire 23 at the rear side of the frame 21.

An engaged side recess hole 21*d* is formed on the front side of the lower outer surface 21*a*. An engagement side triangle protrusion 21*e* protrudes with a low height at the front side of the upper outer surface 21*b*.

The engaged side recess hole 21*d* which is formed on the front side of lower outer surface 21*a* works as a first engaged portion which is engaged with the first trapezoidal protrusion 11*f* which works as a first engagement portion, and which is formed in the cavity 11*c* of the housing 11.

In this embodiment, although the first engagement portion (the first trapezoidal protrusion 11*f*) is formed in a protrusion shape, and the first engaged portion (the engaged side recess hole 21*d*) is formed in a recess shape, their forms are not limited to this embodiment. It is possible to form the first engagement portion in a recess shape on the bottom inner wall 11*e* of the cavity 11*c* and form the first engaged portion in a protrude shape on the lower outer surface 21*a*. Therefore, it is enough that one of the first engagement portion and the first engaged portion has a recess shape and the other has a protrude shape.

The engaged side triangle protrusion 21*e* protruding at the front side of the upper outer surface 21*b* has an inclined surface at the front side of the frame 21 and a vertical surface opposite to the inclined surface.

The engaged side triangle protrusion 21*e* protruding at the front side of the upper outer surface 21*b* works as the second engaged portion which is engaged with the second trapezoidal protrusion 11*i* formed within the cavity 11*c* of the connector housing 11 as the second engagement portion.

Figure 2:
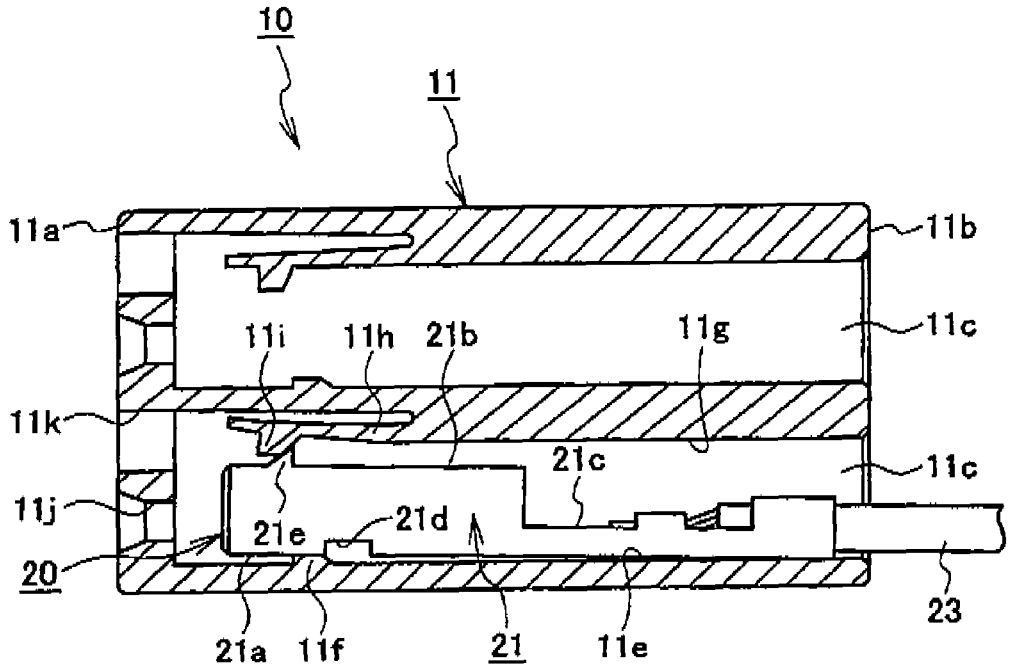
FIG. 2 is a vertical cross sectional view of a connector that explains a middle of a process where the F-terminal is inserted into the connector housing.
Figure 3:
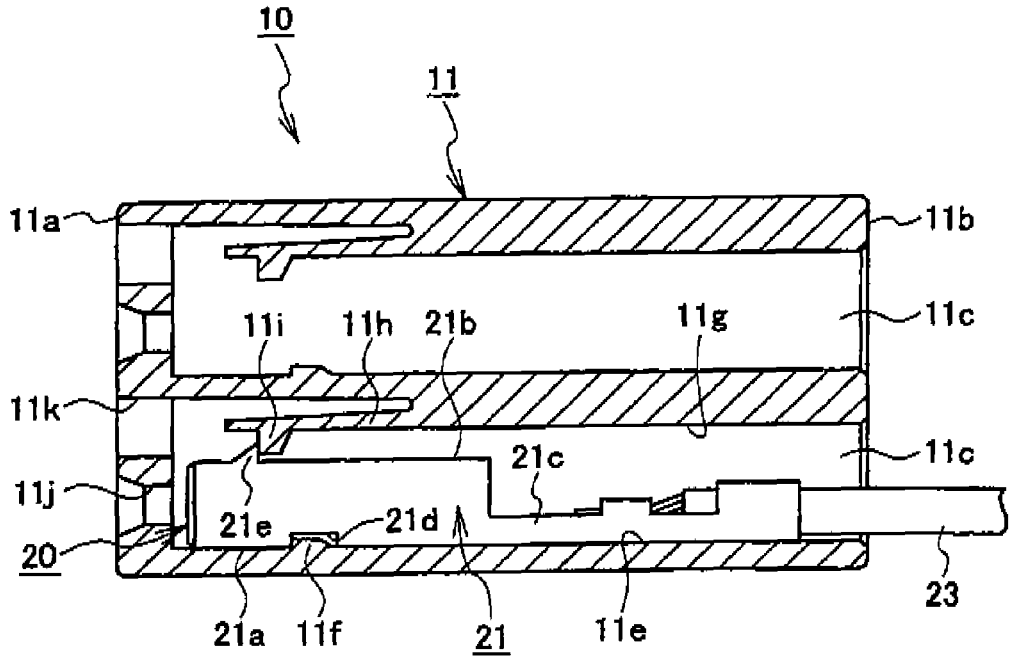
FIG. 3 is a vertical cross sectional view of a connector that explains a situation where the F-terminal is inserted into the connector housing completely.

An operation of the above described embodiment is described briefly with reference to FIG. 2 and FIG. 3.

FIG. 2 is a vertical cross section view of the connector that explains a middle of the process where the F-terminal is inserted into the connector housing. FIG. 3 is a vertical cross sectional view of the connector that explains a situation where the F-terminal is inserted into the connector housing completely.

As shown in FIG. 2, when the F-terminal 20 is inserted into the cavity 11*c* of the connector housing, the front end of the F-terminal 20 is inclined upwardly with respect to the bottom inner wall 11*e* in the cavity 11*c* and inserted into the cavity 11*c*, and then the front end of the lower outer surface 21*a* of the frame 21 overlaps the first trapezoidal protrusion 11*f* protruded on the bottom inner wall 11*e* in the cavity 11*c*. At this time, the first trapezoidal protrusion 11*f* formed on the bottom inner wall 11*e* in the cavity 11*c* does not reach the engaged side recess hole 21*d* formed on the bottom outer surface 21*a* of the frame 21 in the F-terminal 20.

Accompanied with above operation, the engaged-side triangle protrusion 21*e* protruded at the front side of the top outer surface 21*b* of the frame 21 in the F-terminal 20 pushes the second trapezoidal protrusion 11*i* protruded from the top inner wall 11*g* so as to be elastically deformable through the arm 11*h* upwardly.

After that, as shown in FIG. 3, when the F-terminal 20 is further inserted into the cavity 11*c* along the bottom inner wall 11*e*, the first trapezoidal protrusion 11*f* protruded on the bottom inner wall 11*e* in the cavity 11*c* advances into the engaged side recess hole 21*d* formed at the front side of the bottom outer surface 21*a* of the frame 21 in the F-terminal 20. Thus, the engaged side recess hole 21*d* is engaged with the first trapezoidal protrusion 11*f*, and the second trapezoidal protrusion 11*i* protruded from the top inner wall 11*g* so as to be elastically deformable through the arm 11*h* passes over the engaged side triangle protrusion 21*e* protruded from the front end of the top outer surface 21*b* of the frame 21 in the F-terminal 20, so that the engaged side triangle protrusion 21*e* is engaged with the second trapezoidal protrusion 11*i* and is engaged with the triangle protrusion for engagement 21*e*.

When the F-terminal 20 is engaged within the cavity 11*c* of the connector housing 11, the M-terminal (not shown) is able to be inserted and detached through the first hole 11*j* provided on the front side 11*b* of the connector housing 11.

When the F-terminal engaged with in the cavity 11*c* is detached from the cavity 11*c*, the terminal pull out jig (not shown) is inserted through the second hole 11*k* formed on the front side 11*b* of the connector housing 11. Then, the engagement between the second engagement portion 11*i* and the F-terminal 20 is released by touching the terminal pull out jig to the tip of the arm 11*h*.

Accordingly, when the connector 10 is miniaturized, even the pitch of adjacent cavities becomes narrow and the first engagement portion 11*f* formed on the bottom inner wall 11*e* in the cavity 11*c* and the second engagement portion 11*i* formed on the top inner wall 11*g* that is opposite to the bottom inner wall 11*e* so as to be elastically deformable through the arm 11*h* become narrow in width, the first and the second engagement portions 11*f* and 11*i* which are integrally formed in a simple structure enhance the engagement to the first and the second engaged portions 21*d* and 21*e*. Also, both engagements work equally when the F-terminal is engaged within the connector housing 11 because, only the second engagement portion 11*i* is elastically deformable.

The invention claimed is:

1. A connector comprising:

a connector housing forming a cavity extending from an opening and including a top inner wall and a bottom inner wall which face each other, a first engagement portion provided on the bottom inner wall, a second engagement portion which is elastically deformable provided on the top inner wall; and a terminal including a frame which includes an upper outer surface and a lower outer surface which face each other, a first engaged portion provided on the lower outer surface, a second engaged portion provided on the upper outer surface, and a conductive contact provided therein for contacting to a mating terminal, wherein the first engagement portion and the second engagement portion are engaged with the first engaged portion and the second engaged portion respectively when the terminal is inserted into the connector housing, and the first engaged portion is a recess portion and the first engagement portion is a protrusion.

2. The connector according to claim 1, wherein the protrusion is formed in a trapezoidal shape.

3. The connector according to claim 1, wherein as the terminal is inserted into the connector housing, the second engagement portion engages the second engaged portion before the first engagement portion engages the first engaged portion.

4. The connector according to claim 1, wherein the opening from the cavity extends is rectangular, and the frame of the terminal has a box shape.

5. The connector according to claim 1, wherein the connector housing includes an arm supported by the top inner wall so as to elastically deform;

the second engagement portion is a protrusion protruding from a tip of the arm; and the second engaged portion is a protrusion protruding from the upper outer surface.

6. The connector according to claim 5, wherein the protrusion protruding from the upper outer surface is formed in a triangle shape.

7. The connector according to claim 5, wherein the protrusion protruding from the arm is formed in a trapezoidal shape.

8. The connector according to claim 1, wherein the connector housing includes an arm supported by the top inner wall so as to elastically deform;

the second engagement portion is a protrusion protruding from a tip of the arm; and the second engaged portion is a protrusion protruding from the upper outer surface.

9. The connector according to claim 8, wherein the protrusion protruding from the upper outer surface is formed in a triangle shape.

10. The connector according to claim 8, wherein the protrusion protruding from the arm is formed in a trapezoidal shape.

11. A connector comprising:

a connector housing forming a cavity extending from a rectangular opening and including a top inner wall and a bottom inner wall which face each other, a first engagement portion provided on the bottom inner wall, a second engagement portion which is elastically deformable provided on the top inner wall; and a terminal including a frame having a box shape which includes an upper outer surface and a lower outer surface which face each other, a first engaged portion provided on the lower outer surface, a second engaged portion provided on the upper outer surface, and a conductive contact provided therein for contacting to a mating terminal, wherein the first engagement portion and the second engagement portion are engaged with the first engaged portion and the second engaged portion respectively when the terminal is inserted into the connector housing, one of the first engagement portion and the first engaged portion is a recess portion and the other of the first engagement portion and the first engaged portion is a protrusion, and the protrusion is formed in a trapezoidal shape.

12. A connector comprising:

a connector housing forming a cavity extending from a rectangular opening and including a top inner wall and a bottom inner wall which face each other, a first engagement portion provided on the bottom inner wall, a second engagement portion which is elastically deformable provided on the top inner wall; and a terminal including a frame having a box shape which includes an upper outer surface and a lower outer surface which face each other, a first engaged portion provided on the lower outer surface, a second engaged portion provided on the upper outer surface, and a conductive contact provided therein for contacting to a mating terminal, wherein:

the first engagement portion and the second engagement portion are engaged with the first engaged portion and the second engaged portion respectively when the terminal is inserted into the connector housing;

the connector housing includes an arm supported by the top inner wall so as to elastically deform;

the second engagement portion is a protrusion protruding from a tip of the arm;

the second engaged portion is a protrusion from the upper outer surface; and the protrusion protruding from the arm is formed in a trapezoidal shape.

* * * * *